United States Patent [19]

Török et al.

[11] Patent Number: 4,812,711

[45] Date of Patent: Mar. 14, 1989

[54] CORONA DISCHARGE AIR TRANSPORTING ARRANGEMENT

[75] Inventors: Vilmos Török, Lidingö; Andrzej Loreth, Åkersberga, both of Sweden

[73] Assignee: Astra-Vent AB, Stockholm, Sweden

[21] Appl. No.: 31,010

[22] PCT Filed: Dec. 20, 1985

[86] PCT No.: PCT/SE85/00538

§ 371 Date: Jan. 13, 1987

§ 102(e) Date: Jan. 13, 1987

[87] PCT Pub. No.: WO86/07500

PCT Pub. Date: Dec. 18, 1986

[30] Foreign Application Priority Data

Jun. 6, 1985 [WO] PCT Int'l Appl. ..... PCT/SE85/00236

[51] Int. Cl.[4] ..... H01J 7/24; H01T 23/00

[52] U.S. Cl. ..... 315/111.91; 417/48; 430/937; 261/DIG. 42; 313/231.41

[58] Field of Search ..... 417/48, 49; 430/937; 261/DIG. 42; 313/7, 359.1, 103 R, 233, 231.41; 315/111.91, 111.81, 111.1

[56] References Cited

U.S. PATENT DOCUMENTS 4,380,720 4/1983 Fleck ..... 315/111.91

*Primary Examiner*—David K. Moore
*Assistant Examiner*—Mark R. Powell
*Attorney, Agent, or Firm*—Browdy & Neimark

[57] ABSTRACT

An arrangement for transporting air with the aid of so-called ion-wind includes at least one corona electrode (K) and at least one target electrode (M) located downstream of the corona electrode at a distance therefrom. The arrangement also includes a direct-current voltage source, the two terminals of which are connected to the corona electrode and the target electrode respectively. The construction of the corona electrode and the voltage of the voltage source are such that a corona discharge generating air ions occurs at the corona electrode. The occurrence of an ion current flowing in a direction upstream from the corona electrode, and thus counter acting the desired direction of air transport, is prevented by effectively screening the corona electrode in a manner such that the strength of any ion current flowing in the upstream direction and the distance through which such an ion current migrates from the corona electrode is practically zero, or in all events much smaller than the product of the ion-current strength and the distance migrated by the ion current in a direction downstream from the corona electrode. The distance from the corona electrode to that part of the target electrode receiving the predominant part of the ion current is at least 50 mm, and preferably at least 80 mm.

29 Claims, 4 Drawing Sheets

CORONA DISCHARGE AIR TRANSPORTING ARRANGEMENT

BACKGROUND OF THE INVENTION

1. Field of the Invention

Figure 1:
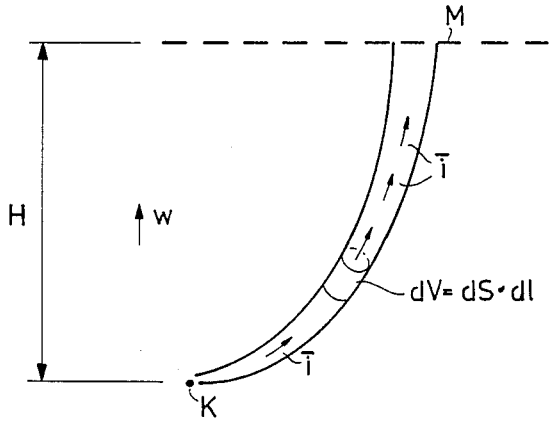

The present invention relates to an arrangement for transporting air with the aid of so-called ion-wind or corona-wind, the arrangement being of the kind set forth in the preamble of claim 1.

2. The Prior Art

The arrangement has been developed primarily for use in conjunction with air purifying devices, such as electrostatic precipitators for example, and air processing systems, such as ventilation systems and air-conditioning systems, for example, although the invention can also be used to advantage in many other connections where air is required to be transported, such as when cooling electrical apparatus or electrical equipment, and in conjunction with heating devices, such as electric hot-air blaze.

Today, air is transported in the aforesaid apparatus, systems etc. almost exclusively with the aid of mechanical fans of mutually different design. Such mechanical fans and associated drive motors are relatively expensive, in addition to being heavy and requiring a considerable amount of space. They also have a relatively high energy requirement, and are consequently expensive to run. In operation the fans also generate a considerable amount of noise, which is highly troublesome in many areas in which such fans or blowers are used, for example in dwelling places and in certain working locations.

It is known that the transportation of air can be achieved, in principle, with the aid of so-called ion-wind or corona-wind. An ion-wind is created when a corona electrode and a target electrode are arranged at a distance from one another and each connected to a respective terminal of a direct-current voltage source, the corona-electrode design and the voltage of the direct-current voltage source being such as to cause a corona discharge at the corona electrode. This corona discharge results in ionization of the air, with the ions having the same polarity as the polarity of the corona element, and possibly also electrically charged so-called aerosols, i.e. solid particles or liquid particles present in the air and becoming electrically charged upon collision with the electrically charged air ions. The air ions move rapidly, under the influence of the electric field, from the corona electrode to the target electrode, where they relinquish their electric charge and return to electrically neutral air molecules. During their passage between the electrodes, the air ions are constantly in collision with the electrically neutral air molecules, whereby the electrostatic forces are also transferred to these latter air molecules, which are thus drawn with the air ions in a direction from the corona electrode to the target electrode, thereby causing air to be transported in the form of a so-called ion-wind or corona-wind.

Arrangements for transporting air with the aid of ion-winds are known to the art, and examples of such apparatus are described and illustrated, inter alia, in DE-OS No. 2 854 716, DE-OS No. 2 538 959, GB-A No. 2 112 582, EP-Al No. 29 421 and U.S. Pat. No. 4,380,720. These prior art air-transporting arrangements utilizing ion-wind or corona-wind have been found extremely ineffective however, and have not achieved any practical significance. It would seem that a reason for this is a lack of understanding of the physical mechanisms responsible for the total transportation of air through an arrangement of this kind. Consequently, it is not possible with the previously suggested embodiments of ion-wind operated air transporting arrangements to achieve in practice the transportation of significant quantities of air without needing to raise the corona current to levels which lie considerably above those levels which can be considered acceptable when using such an arrangement in populated environments. It is well known, inter alia, from the electrostatic precipitator field, that an electric corona discharge generates chemical compounds, primarily ozone and oxides of nitrogen, which have an irritating effect on human beings, and which can be harmful to the health when present in the air in excessively high concentrations. In the event of a corona discharge these chemical compounds are generated at a rate which is contingent on the magnitude and polarity of the electric corona current. Consequently, present day electrostatic air filters for use in human, or populated, environments operate with a positive corona discharge and a corona current having an amperage which is substantially proportional to the quantity of air passing through the filter per unit of time in normal operating conditions. In this respect the corona current is of the order of 40–80 $\mu$A at an air-throughput of 100 $m^3/h$, the strength of the current being adapted to the requirement for an acceptable level of ozone and Nox generation. It will be understood that the corona current utilized in air-transporting arrangements which operate with an ion-wind and are used in the presence of people, i.e. human environments, must also be restricted to the aforesaid magnitude. This is not possible to achieve with the prior art air transporting arrangements utilizing ion-wind, due to the poor efficiency of the arrangements. For example, according to reports, it is possible to achieve with the arrangement proposed in EP-Al No. 29 421 and U.S. Pat. No. 4,380,720 an air throughput of 1 l/s with the aid of a corona power of 1 W at a preferred corona voltage of 15 kV. Thus, when converted to an air throughput of 100 $m^3/h$ this arrangement will consume about 1900 $\mu$A, which is roughly thirty times higher than the corona-current value acceptable in human environments.

Consequently an object of the present invention is to provide an improved and much more effective air transporting arrangement of the kind mentioned in the introduction, and one which is so efficient as to enable it also to be used in practice in a human environment.

The arrangement according to the invention is based on a more profound and improved understanding, previously unachieved, of the mechanisms decisive for the total transportation of air through an arrangement of this kind, and has the characterizing features set forth in the following claims.

BRIEF DESCRIPTION OF THE INVENTION

Figure 6:
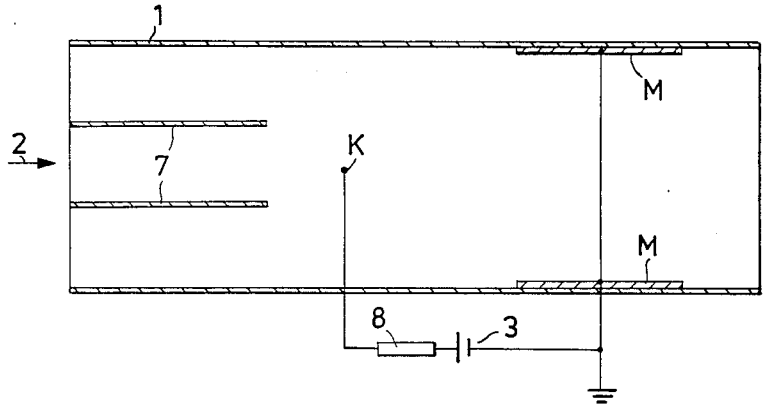
Figure 7:
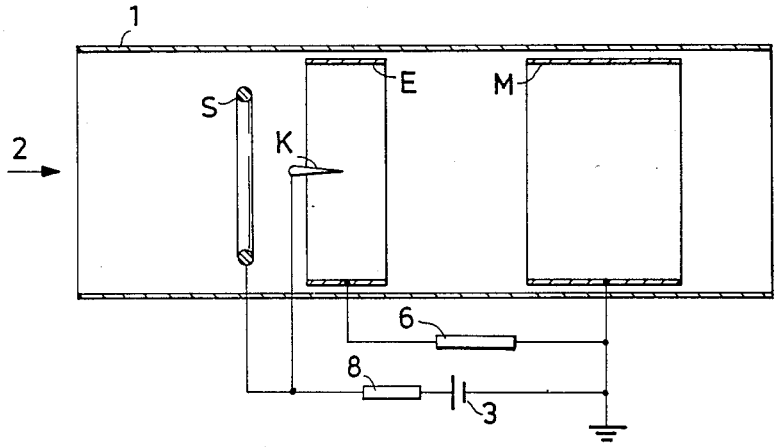
Figure 8:
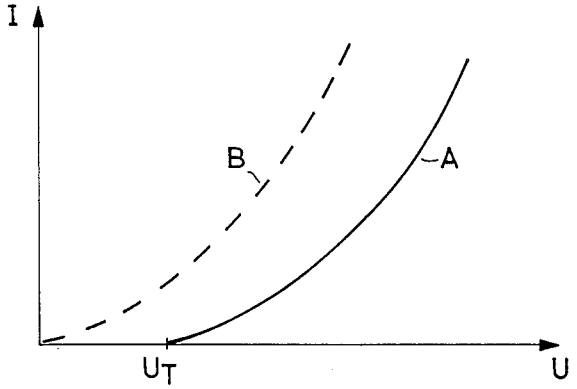

The invention will now be described in more detail with reference to the accompanying drawings, in which:

FIG. 1 is a schematic illustration of ion migration between a corona electrode and a target electrode;

FIGS. 2, 3, 4, 5, 6, 7, 9, 10, 11, 12, and 13 illustrate schematically a number of different embodiments of an arrangement according to the invention; and FIG. 8 is a diagram of the corona current as a function of the voltage.

DETAIL DESCRIPTION OF THE PREFERRED EMBODIMENT

There will first be given a synopsis of the fundamental conditions determinative for the transportation of air capable of being obtained with the aid of an ion-wind or corona-wind generated between a corona electrode and a target electrode arranged axially downstream of the corona electrode in the desired flow direction. FIG. 1 illustrates schematically a corona electrode K in the form of a thin wire extending across the airflow path, e.g. across an airflow duct, and a target electrode M which also extends across the airflow path and which is shown schematically and by way of example, in the form of a net or grid structure which is permeable to the airflow. The target electrode M is placed downstream of the corona electrode K in the desired direction of airflow, shown by an arrow w, at an axial distance H from the corona electrode K.

As previously mentioned, the corona discharge created at the corona electrode gives rise to electrically charged air ions, which migrate in a direction towards the target electrode under the influence of the electric field present between the corona electrode and the target electrode.

The mobility of the ions varies within a wide spectrum, although for the present purpose it can be assumed that lightweight ions having the mobility $$c=2.5\cdot10^{-4}\ \mathrm{m^2/Vs}$$

are predominant, and that any electrically charged aerosols present, which are far less mobile than the air ions, only constitute a negligible part of the total charge in the system. It can also be assumed that the air ions constitute a very small fraction of the total mass of the air within the system, and that the flow rate of the air is at least one power of ten lower than the speed of motion of the air ions. Thus, with respect to the migration velocity of the air ions the surrounding air can be assumed to be stationary.

The migration velocity v of electrically charged air ions in relation to the surrounding air is proportional to the product of their mobility c and the strength E of the electric field and hence $$\bar{v}=c\cdot\bar{E} \tag{1}$$

It is also assumed that steady state conditions prevail, so that the charge density in a given part-volume of the system is constant, i.e. that the electrical charge per unit time supplied to the system is equal to that removed from the system. Consequently, the current density in the air can be expressed as the product of the migration velocity v of the charges and the charge density $\rho$ $$\bar{i}=\rho\cdot\bar{v} \tag{2}$$

where $\bar{i}$ is the current density.

The specific volumetric force in the air is the product of the charge density $\rho$ and the electric field strength E, and hence $$\bar{f}=\rho\cdot\bar{E} \tag{3}$$

where $\bar{f}$ is the driving force per unit volume of air.

When applying the above equations (1), (2) and (3) there is thus obtained $$\bar{f}=\bar{i}/c \tag{4}$$

i.e. the specific volumetric force can be expressed as the ratio of the current density to the ion mobility.

As illustrated in FIG. 1, we now consider a "current duct", which conducts an infinitesimally small part dI of the total ion flow I between the two electrodes K and M. The centre line of this current duct is always parallel with the current density vector $\bar{i}$ and its cross-sectional area dS has a surface normal which is parallel with the current-density vector.

We now consider a volume element $$dV=dS\cdot dl \tag{5}$$

of this current duct, where dV is an infinitesimal volume and dl is an infinitesimal length in the direction of the current duct. The force acting in the direction of the surface normal on each such volume element in the current duct becomes $$d\bar{F}=\bar{f}\cdot dV=\bar{f}\cdot dS\cdot dl \tag{6}$$

This volumentric force $d\bar{F}$ has a component in the direction $\bar{w}$ of air transportation and a component at right angles to said direction. It is assumed that when totalled across the whole cross-sectional area of the airflow path or duct in the arrangement these transverse forces will cancel out each other and can therefore be ignored. Consequently, the total transportation force in a current duct is $$dF_T=\int_K^M w\cdot dF=\int_K^M w\cdot f\cdot dS\cdot dl=\int_K^M w\cdot i/c\cdot dS\cdot dl=dI/c\int_K^M w\cdot dl=H/c\cdot dI \tag{7}$$

where H is the distance between the corona electrode K and the target electrode M in the direction of airflow.

The total transportation force $F_T$ in the airflow duct can thus be expressed as $$F_T=\iint_S dF_T=H/c\cdot I \tag{8}$$

where S is the total cross-sectional area of the airflow duct and I is the total ion or corona current.

Thus, the average pressure setup can be written as $$\Delta p=F_T/S=H/c\cdot I/S \tag{9}$$

The transportation force is thus proportional to the product of the total ion or corona current I and its migration path H, i.e. proportional to the so-called "current-distance" H.I.

It can be shown that the total air throughput as a result of this pressure setup can be written as $$Q=\sqrt{\frac{2}{c\cdot k\cdot\gamma_A}}\cdot\sqrt{I\cdot H\cdot S} \tag{10}$$

where Q is the air throughput, k is a dimensionless aerodynamic resistance coefficient and $\lambda_A$ is the density of the air.

It will be seen from the equation (10) that the magnitude of air transportation is directly proportional to the square root of the product between the total ion or corona current I and its migration distance H.

Thus, in order to achieve a high air throughput in the desired direction, i.e. in a direction away from the corona electrode and towards the target electrode, it should be endeavoured to attain a high product of the ion current and its migration distance in a direction downstream from the corona electrode, i.e. from the corona electrode towards the target electrode. An increase in the transporting force, and therewith in the total air throughput, can be achieved either by increasing the strength of the total ion current or by increasing the distance between the corona electrode and the target electrode. As beforementioned, when used in a human environment, however, it is not permissable to increase the strength of the ion or corona current to a level which exceeds a given maximum in view of the ensuing production of harmful ozone and oxides of nitrogen (Nox), this production being primarily proportional to the corona current. Consequently, the only remaining parameter capable of being influenced in this regard is the distance migrated by the corona current, i.e. the axial distance between the corona electrode and the target electrode. Accordingly, it is proposed in accordance with the invention that the distance between the corona electrode and the part of the target electrode receiving the predominant part of the ion current is at shortest 50 mm, and preferably measures at least 80 mm.

It will also be seen that when using an air transportation arrangement of the aforedescribed kind, a stream of air ions is also able to migrate from the corona electrode in an upstream direction, i.e. in a direction opposite to the desired direction of air transportation, if there is located upstream of the corona electrode an electrically conductive object or subject having an electrical potential in relation to the corona electrode which makes such migration of the air ions possible. It will be understood that this greatly reduces the total desired transportation of air through the arrangement. To the extent that this possibility of a stream of ions passing from the corona electrode in an upstream direction therefrom has been taken into account when designing known air transporting arrangements of the kind discussed here, it would appear to have been assumed sufficient to ensure that electrically conductive objects upstream of the corona electrode are located at a considerable distance therefrom and that the flow of ion current directed upstream is small. However, since the transportation force created by the ion flow is proportional to the product of the strength of said flow and the distance travelled thereby, as made evident in the above equation (9), it will be seen, to the contrary, that even a very small stream of ions from the corona electrode in a direction upstream therefrom can give rise to a significant transportation force in a direction opposite to the desired direction of air transportation, when this upstream directed stream of ions has a long path to travel.

It must be observed in the present context that the term "electrically conductive" must be interpreted in relation to the extremely small current strengths prevailing in an arrangement of the present kind, these current strengths normally being of the order of 1 $mA/m^2$. Consequently, in the case of an air transporting arrangement of the kind to which the present invention refers, objects which can be considered to be electrically conductive or which have a surface which can be considered as electrically conductive will, in practice, always be found upstream of the corona electrode. These objects may, for example, comprise grids or net structures or other parts of the arrangement itself located at the inlet to the airflow duct of the arrangement. Even in the absence of such arrangement components, such objects as wall surfaces, pieces of equipment or furniture and even people, which are present in the area in which the arrangement is placed and located in the vicinity of the inlet to the airflow duct of the arrangement can serve as electrically conductive surfaces to which a stream of ions can migrate from the corona electrode upstream in the duct.

This sought for improvement in efficiency, i.e. a high air throughput with the aid of a corona current limited to an acceptable value, is achieved in the air transporting arrangement according to the invention, partly by locating the target electrode at such a distance from the corona electrode that the distance from the corona electrode to that part of the target electrode receiving the predominant part of the ion current, i.e. the migration distance of the ion current downstream from the corona electrode, is at shortest 50 mm, and preferably not shorter than 80 mm, and partly by ensuring that the product of the ion-current strength and the distance migrated by the current in the upstream direction away from the corona electrode is practically zero, or in all events much smaller than the corresponding product of ion-current strength and the migration distance of the current in the downstream direction, away from the corona electrode. This latter is effected in accordance with the invention by effectively screening the corona electrode in the upstream direction, so that no ion current is able to flow from the corona electrode in the upstream direction, or at least so that any ion current able to flow in the upstream direction is only very small and travels through only a very short distance.

According to one embodiment of the invention, the aforesaid necessary screening of the corona electrode in the upstream direction can be achieved by connecting the terminal of the direct current source connected to the corona electrode to a potential which coincides substantially with the potential of the immediate surroundings of the arrangement, i.e. in practice is earthed in the same manner as the casing which houses the arrangement and as the remaining inactive, electrical components. To the extent that it has previously been proposed in conjunction with air transporting arrangements of this kind to locate the corona electrode at earth potential instead of a high potential, these two alternatives have previously been considered to be equivalent to one another with respect to the mechanism of air transportation, and connection of the corona electrode to earth potential has not been effected in an endeavour to screen the corona electrode in the upstream direction.

In many cases, however, it is not desirable to connect the corona electrode to earth potential, since for various practical reasons it may be desired to connect the target electrode to earth potential, or to connect the corona electrode and the target electrode to opposite polarities relative to earth, and therewith reduce the need for high-voltage insulation. In cases such as these the desired screening of the corona electrode in the upstream direction can be achieved, in accordance with another embodiment of the invention, with the aid of a method known from other areas of the electrotechnical field, by arranging an electrically conductive screening element upstream of the corona electrode and giving to said element a potential which coincides substantially with the potential of the corona electrode, so that they form upstream of the corona electrode an equipotential barrier which is substantially impenetrable to ions flowing in the upstream direction. To the extent that the provision of a screen electrode upstream of the corona electrode and connected to the same potential as said electrode has been previously proposed in conjunction with air transporting arrangement of the kind in question, such proposals have been made in conjunction with an air transporting arrangement of cascade construction, comprising a plurality of corona-electrode arrays and target-electrode arrays arranged in axial sequential relationship in an airflow duct. It has not earlier been understood or perceived that effective screening of the corona electrode against an ion current in the upstream direction is, under all circumstances, essential to the efficiency of the air transporting arrangement.

A third and extremely surprising possibility of effecting the necessary screening of the corona electrode against an undesirable flow of ions in the upstream direction resides in extending an airflow duct encompassing the electrodes of the arrangement through a substantial distance upstream of the corona electrode, i.e. at the inlet end of the airflow duct, the walls of said duct expediently consisting of a dielectric material, for example a suitable plastics material, in a known and obvious manner. Tests have shown that when operating an air transporting arrangement of the kind in question, there appears on the dielectric walls of the airflow duct an excess of electric surface charges which remain all the time the material is subject to the prevailing electric field. By "excess charges" is meant here electrical charges on the surface of the dielectric material additional to the surface charges assumed by the classical understanding of dielectric material of weak electrical conductivity. It has not been clearly established why these excess charges occur on the dielectric walls of the airflow duct, although the phenomenon itself has been established experimentally. The phenomenon would seem to be related to the phenomena utilized when manufacturing dielectric electrets. In this latter case, special dielectric material is subjected to a combination of highly electric field and ion currents. Electrical excess charges are therewith bound permanently in the structure of the material, and are not conducted away despite the fact that the material is electrically conductive to a certain degree. Consequently, in conjunction with aforestated phenomenon encountered in air transporting arrangements of the kind in question, it is an obvious assumption to one skilled in this art that the electrical excess charges on the dielectric walls of the airflow duct are also bound to the structure of the dielectric material, but only provided that the material is exposed to the influence of an electric field. This phenomenon can be used beneficially to achieve necessary screening of the corona electrode in the upstream direction, by extending the airflow duct and its dielectric walls upstream, away from the corona electrode, i.e. at the inlet end of the duct, through a distance such that the excess charges appearing on the duct walls under the influence of an ion current from the corona electrode immediately after switching on the arrangement, effectively screen the ion cloud present around the corona electrode against the possible occurrence of an electric field upstream of the corona electrode, so as to obtain thereby an effective shield against an upstream-directed ion current from the corona electrode. It will be seen that the further the airflow duct is extended upstream of the corona electrode, the greater the efficiency of the screen provided. Tests have shown that a satisfactory screening effect can be obtained when the distance through which the airflow duct is extended upstream of the corona electrode is at least 1.5 times the distance between the corona electrode and the target electrode. It will also be seen that the screening effect becomes more efficient with decreasing widths of the airflow duct, i.e. the smaller the distance between mutually opposing dielectric walls, the greater the efficiency of the screening effect produced. In the case of an airflow duct of relatively large cross-sectional area, the screening effect can be increased substantially, by dividing the duct into a plurality of mutually parallel part-ducts upstream of the corona electrode, with the aid of elongated partition walls extending parallel with the walls of the duct, for example partition walls in the form of strips or the like of dielectric material. An arrangement such as this will enable the corona electrode to be screened effectively against an ion current in the upstream direction even though the distance to which the airflow duct is extended upstream of the corona electrode is only roughly equal to the distance between the corona electrode and the target electrode.

Another serious problem encountered with air transporting arrangements of this kind intended for use in a human environment, is that they must be safe to touch in spite of the high voltages used. A touch guard can, of course, be provided with the aid of mechanical means, by providing the airflow duct surrounding the electrodes of the arrangement with fully impervious walls and fitting the duct with a protective grid at both its inlet and its outlet end, so that it is impossible to touch the voltage carrying electrodes of the arrangement, either unintentionally or intentionally. Such guards, however, present a significant resistance to flow and therewith seriously impair the transport of air through the arrangement, and therewith its efficiency. It has been found possible in an arrangement according to the invention, however, to provide perfectly satisfactory safety precautions against contact with the arrangement in a much simpler and more advantageous manner. As described in the aforegoing, an arrangement constructed in accordance with the present invention operates with an extremely low corona current, in the order of 20–50 $\mu$A per 100 $m^3/h$ transported air. This extremely low specific value of the corona current is made possible due to the large axial distance between corona electrode and target electrode, and the effective screening of the corona electrode in the upstream direction. As a result of this low current consumption, the voltage carrying electrodes of the arrangement, irrespective of whether it is the corona electrode or the target electrode, can be connected to its associated terminal of the voltage source through an extremely high resistance, without needing to increase the voltage of the voltage source to an unacceptable extent. It has been found that this series resistance can be readily given, with no difficulty whatsoever, a resistance value of such high magnitude that in the event of the voltage carrying electrode being short-circuited directly, the short circuiting current is so low as to be totally harmless. A limit value of 2 mA is normally set with regard to a harmless short circuiting current from the aspect of bodily contact with such electrical appliances. If the short circuiting current is made as low as about 100–300 μA, no unpleasant sensations at all are experienced when touching the voltage carrying electrode. This can readily be achieved with an arrangement according to the invention. If it is assumed, for example, that the voltage carrying electrode of an arrangement shall have an operating voltage of 20 kV and the corona current is 50 μA, the voltage carrying electrode can be connected to the corresponding terminal of the voltage source through a resistance of, for example, 150 MΩ, wherewith the voltage source itself must thus have a terminal voltage of 27.5 kV. When the voltage carrying electrode is directly shortcircuited, the short circuiting current will therewith be solely about 185 μA, which is of such low magnitude as to cause no discomfort, should the short circuit be caused by direct contact with the electrode. This limitation of the short circuiting current to a value which causes no discomfort when coming into direct personal contact with the voltage carrying electrode has been totally unattainable in practice, however, with the large corona currents, in the order of 2000 μA, which must, of necessity, be used in prior art air transporting arrangements operating with an electric ionwind. Another significant factor of the contact safety-precaution, additional to the low level of the short circuiting current, is the capacitive discharge current which can occur when an electrode of a given capacitance is touched. In the case of electrodes of such design as to have significant capacitance, however, the capacitive discharge current can be reduced to fully acceptable levels, by forming these electrodes from a material of high resistivity, in accordance with the invention. This creates no other drawbacks, since the electrodes do not need to be highly conductive, in view of the low current strengths which can be used in accordance with the invention while still providing an efficient air transporting arrangement.

Figure 2:
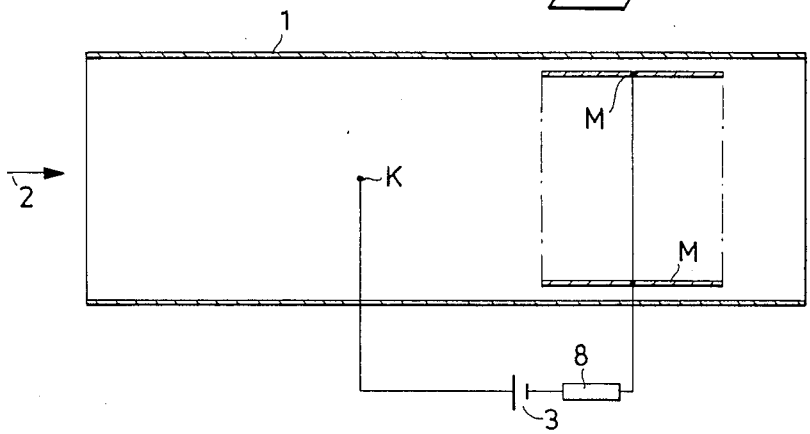

FIG. 2 of the accompanying drawings illustrates schematically and by way of example the principle construction of a first embodiment of an air transporting arrangement according to the invention. This arrangement includes an airflow duct 1 which is made of an electrically insulating material and through which a flow of air is to be produced in the direction identified by an arrow 2. Arranged in the airflow duct is a corona electrode K which is permeable to the airflow, while arranged axially downstream of the corona electrode is a target electrode M, which is also permeable to the airflow. The corona electrode K comprises an electrically conductive material, which is preferably ozone and ultraviolet resistant, and may be constructed in a number of different known ways, to proof an electric field. The corona electrode K of the FIG. 2 embodiment is shown, by way of example, to comprise a thin wire or filament which extends across the airflow duct 1. The corona electrode may have many other different forms however. For example, it may comprise a plurality of thin wires or filaments arranged either parallel with one another or in the form of an open mesh grid or net. Instead of using straight, thin wires or filaments, the wires may be wound spirally, or thin strips exhibiting straight, serrated or undulating edge surfaces may be arranged in a similar manner. The corona electrode may also comprise one or more needle-like electrode elements directed substantially axially in the airflow duct 1. The target electrode M comprises an electrically conductive or semi-conductive material, or a material coated with an electrically conductive or semi-conductive surface, and is provided with surfaces which will not give rise to a powerful concentration of electric fields. The target electrode may also be constructed in a number of different, known ways, partly in dependence on the construction of the corona electrode. In the FIG. 2 embodiment the target electrode M is shown to comprise, by way of example, two mutually parallel plates located in the direction of the airflow duct. In the case of needle-shaped corona electrode the target electrode advantageously has the form of a cylinder arranged coaxially with the airflow duct. An electrically conductive surface coating on the inside of the airflow duct 1 may also serve as the target electrode. The target electrode may also comprise a plurality of planar or cylindrical electrode elements arranged in side-by-side relationship, with their side surfaces substantially parallel with the longitudinal axis of the airflow duct 1. The target electrode may also comprise straight or helically wound wires, or straight rods which may be arranged mutually parallel with one another or to cross one another to form a grid structure, or may have the form of a perforated disc. A particular advantage is afforded, however, when the target electrode has the form of an electrically conductive or semi-conductive surface which embraces the airflow duct in the form of a frame and which has an extension parallel with the airflow direction corresponding to at least one fifth of the distance between corona electrode and target electrode.

The aforedescribed exemplifying embodiments of the corona electrode and the target electrode can, in principle, be used in all of the embodiments or arrangements according to the invention described hereinafter.

In the arrangement illustrated in FIG. 2 the corona electrode K and the target electrode M are each connected in a conventional manner to a respective pole or terminal of a direct-current voltage source 3. In the illustrated example the corona electrode K is connected to the positive terminal of the voltage source 3, so as to obtain a positive corona discharge. In principle, however, the polarity of the voltage source 3 may also be the opposite, so as to obtain a negative corona discharge. A positive corona discharge is generally to be preferred, however, since less ozone, which is a poisonous gas, is produced with a positive corona discharge than with a negative discharge.

In the arrangement illustrated in FIG. 2 the terminal of the voltage source 3 connected to the corona electrode K is earthed, in accordance with the invention, so that the potential of the corona electrode K coincides substantially with the potential of all other electrically inactive parts of the actual arrangement similarly earthed, and also with the potential of the immediate surroundings of the arrangement. The potential of the corona electrode K will, in this way, be the same as the potential of the environmental conditions located upstream of the corona electrode K, with any electrically conductive objects or surfaces located in said environment, and hence no undesirable flow of ions will be obtained from the corona electrode K in a direction upstream therefrom.

As mentioned in the aforegoing, the axial distance between the corona electrode K and that part of the target electrode M which receives the predominant part of the ion current is at least 50 mm, and preferably at least 80 mm, whereby air can be transported through the airflow duct at a throughput of, for example, 100 $m^3/h$ with the aid of a low corona current in the order of 20–50 μA, which is an acceptable value with respect to the production of ozone and oxides of nitrogen. Further, as previously mentioned, an advantage is gained when the target electrode M is connected to the d.c. voltage source 3 through a large limiting resistance 8, which in the event of a short circuit caused by touching the target electrode M limits the short circuiting current to a value of at most about 300 μA. Since, as a result of its construction, the target electrode M has a not insignificant capacitance, it can suitably be made from a material of high resistivity. A suitable material in this respect, having a high resistivity and, at the same time, the requisite ability to conduct electricity, is a plastics material which incorporates a finely divided electrically conductive material, such as carbon black for example. Known materials of this kind from which target electrodes can be produced have a surface resistivity in the order of 100 kΩ and more.

Figure 3:
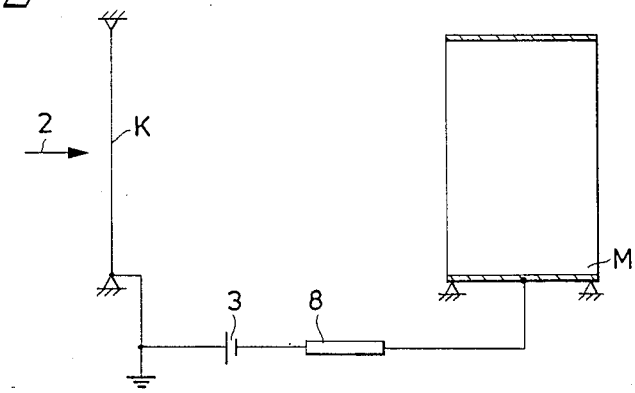

It will be understood from the aforegoing that an arrangement constructed in accordance with the invention, for example in the manner illustrated in FIG. 2, is quite safe to touch, and hence it is not necessary to take any other safety measures or to provide any form of safety device in order to prevent intentional or unintentional contact with either the corona electrode K or the target electrode M. Furthermore, since the corona electrode K is earthed, there is no risk of ion current flowing through any other location than the target electrode. When seen as a whole, this surprisingly enables, in reality, an air transporting arrangement according to the invention to be constructed without including any form of air-flow duct 1 whatsoever, at least when the primary purpose of the arrangement is to cause air to move in the space or area in which the arrangement is installed. For example, an arrangement constructed in accordance with the invention may have the extremely simple form illustrated in FIG. 3. This embodiment of the arrangement according to the invention includes a corona electrode K in the form of a wire stretched between holder means (shown solely schematically) carried by suitable frame means (not shown in detail), and a target electrode M which is spaced from the corona electrode K and also carried by the aforesaid frame means. The target electrode M may comprise two mutually parallel, electrically conductive surfaces, which also lie parallel to the corona electrode K. Alternatively, the target electrode M may comprise a rectangular or circular frame-like electrode surface whose axial extension coincides with the desired airflow direction 2, as illustrated in the figure, this embodiment of the target electrode being the one preferred. It will be seen that in this embodiment there is no airflow duct whatsoever surrounding the two electrodes K and M. As with the FIG. 2 embodiment, the corona electrode K is connected to earth and to one terminal of the d.c. voltage source 3, whereas the target electrode M is connected to the other terminal of the source 3 through a large ohmic resistance effective to limit a short circuiting current to an acceptable value, in the event of a short circuit created by contact with the target electrode M. The target electrode M is also formed from a material of high resistivity, so as to limit the capacitive discharge current when contact is made with the target electrode. Tests carried out with an arrangement constructed in the manner illustrated in FIG. 3 showed that the arrangement is able to transport air very effectively in the direction indicated by the arrow 2, within the area embraced by the target electrode M. The tested arrangement incorporated a rectangular, frame-like target electrode M having a cross-sectional area of 600×60 mm and an axial length of 25 mm. The distance of the target electrode from the corona electrode K was 100 mm. A voltage of 25 kV was applied to the target electrode M, and the corona current was 30 μA. The d.c. voltage source 3 had a terminal voltage of 29 kV, and the series resistance 8 had a resistance of 132 MΩ. This extremely simple arrangement resulted in an airflow of 60 $m^3/h$ through the area enclosed by the target electrode M. When short circuiting the target electrode M of this arrangement, the short circuiting current was found to be only ≈220 μA, i.e. a current strength which can hardly be felt should personal contact be made with the target electrode M. The arrangement is thus perfectly safe to touch, provided that the actual voltage source 3 itself is electrically safe to touch.

As before mentioned, many cases are to be found in which it is not desirable for the corona electrode to be connected to earth potential. In cases such as these, the requisite screening of the corona electrode in accordance with the invention can be achieved with an arrangement of the kind illustrated schematically and by way of example in FIG. 4. In this arrangement, the negative terminal of the d.c. voltage source 3, and therewith also the target electrode M, is connected to earth, whereas the corona electrode K is connected to the positive terminal through a large resistance effective to limit the short circuiting current to an acceptable value in the event of a short circuit due to contact with the corona electrode K. In order to prevent ions from migrating upstream from the corona electrode K, a screen electrode S is arranged upstream of the corona electrode and connected thereto, so that the screen electrode S and the corona electrode K both have mutually the same potential. The screen electrode S may have one of a number of different forms, depending upon the construction or form of the corona electrode used. When the corona electrode K comprises a thin, straight wire, the screen electrode may, for example, have the form of a rod or a helically formed wire. The screen electrode may also comprise a plurality of rods or wires arranged in mutually parallel relationship or in a diamond configuration. The screen electrode S may also be in the form of a net or grid-like structure. Alternatively, the screen electrode may comprise electrically conductive surfaces placed in the close proximity of the wall of an airflow duct 1 or on the inner surfaces of said wall. In principle, the screen electrode S is given a geometric configuration and position relative to the corona electrode K such that the screen electrode S forms an equipotential barrier or surface which is impermeable to ions emanating from the corona electrode K.

Figure 5:
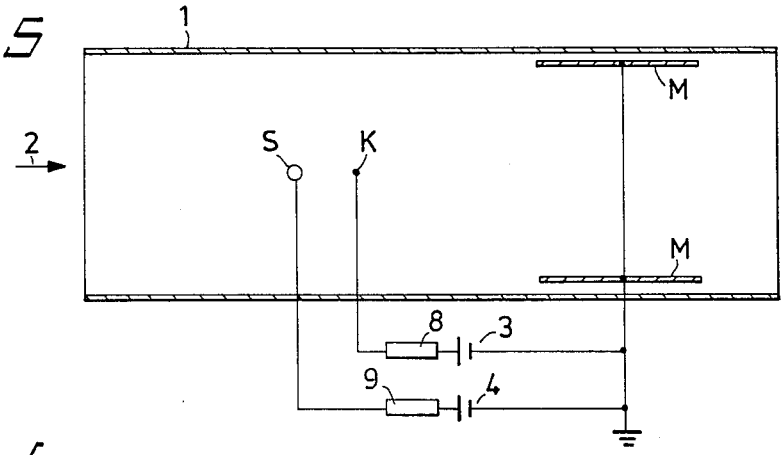

The screen electrode S need not necessarily be electrically connected directly to the corona electrode K, but may also be connected to the one terminal of a further d.c. voltage source 4, as schematically illustrated in FIG. 5, in a manner such that the screen electrode S has the same polarity as the corona electrode K in relation to the target electrode M, and preferably a potential which coincides substantially with the potential of the corona electrode K. The screen electrode S is, herewith, connected to the voltage source 4 through a large resistance 9 effective to limit the short circuiting current in the event of contact with the screen electrode 5.

It will be seen that in the case of an arrangement according to FIG. 5 when the screen electrode S has a higher positive potential in relation to the target electrode M than the corona electrode K, the flow of ions in a direction upstream from the corona electrode K is also effectively prevented hereby. Even though the screen electrode S might have a somewhat lower positive potential than the corona electrode K, so that a small ion current is able to flow from the corona electrode to the screen electrode S upstream thereof, this can be accepted provided that there is only a short distance between the corona electrode K and the screen electrode S, so that the distance through which the ion current migrates in the upstream direction is very short, and therewith also the so-called current distance.

Figure 4:
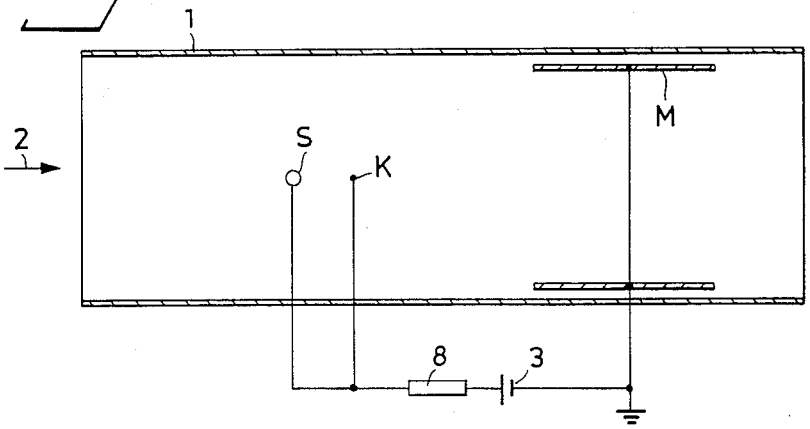

It will be understood that when the screen electrode S of the embodiment of FIG. 4 or FIG. 5 has a form, or construction, such as to present a significant capacitance, the electrode is preferably made of a material of high resistivity, so as to limit the capacitive discharge current to an acceptable level in the event of contact being made with the electrode. This applies generally to all voltage carrying electrodes incorporated in an arrangement constructed in accordance with the invention, when these electrodes have a not insignificant capacitance. The corona electrode, however, is normally always designed to have a very small capacitance, such as to be incapable of giving rise to significant capacitive discharge currents. Another generally applicable feature is that all electrodes of an arrangement according to the invention connected to a non-earthed terminal of a d.c. voltage source are preferably connected to said source through a resistance of such high magnitude that in the event of a short circuit created by contact with the electrode, the short circuiting current is limited to at most 300 $\mu$A.

As mentioned in the aforegoing, requisite screening of the corona electrode against an undesirable flow of ions in the upstream direction can also be achieved electrostatically, for example in the manner illustrated in FIG. 6. In this embodiment, the airflow duct 1, the walls of which consist of a dielectric material, such as a suitable plastics material, is extended through some considerable distance from the corona electrode K in the upstream direction. When the arrangement is in its operational mode there is produced on the walls of the duct 1 an excess of surface charges which generate an effective shield against the ion cloud in the vicinity of the corona electrode K, provided that the duct 1 extends through a sufficient distance from the corona electrode in said upstream direction. This effectively prevents the migration of an ion current in a direction upstream of the corona electrode K. The efficiency of the screen can be further improved, by dividing the airflow duct upstream of the corona electrode K into a plurality of part-ducts, with the aid of elongated partition walls, plates or strips 7 made of a dielectric material, as schematically illustrated in FIG. 6. In order to provide an effective screen, the length of duct 1 located upstream of the corona electrode K should be at least equal to the distance of the corona electrode from the target electrode M, and preferably at least 1.5 times this distance. The length of duct required to provide an effective and efficient screen depends on the geometry of the airflow duct 1, and then primarily on its cross-sectional configuration, and on whether or not dielectric partition walls 7 have been provided in the duct 1, upstream of the corona electrode 7. When seen generally, it will also be understood that the demands placed on this screening of the corona electrode will depend upon the difference in potential between the corona electrode and the earthed surroundings; a smaller difference in these potentials will thus lessen the demands which need be placed on the screen.

When the corona electrode of an air transporting arrangement according to the present invention is effectively screened in one of the ways aforedescribed, such that substantially no ions will flow in the upstream direction from the corona electrode, the effective transportation of air through the arrangement is determined primarily by the transport force generated by the ion current flowing from the corona electrode K to the target electrode M, and is proportional to the product of said ion current and the distance between the corona electrode and the target electrode.

An increase in the distance between the corona electrode K and the target electrode M, while simultaneously maintaining an unchanged ion current between the electrodes, can be achieved by increasing the voltage connected between the two electrodes, from the voltage source 3. Consequently, in accordance with the invention, there is advantageously applied between the corona electrode and the target electrode a difference in potential of higher magnitude than has hitherto been usual in, for example, electrostatic filters or precipitators of the kind used in domestic dwellings. It will be understood that when the potential of the corona electrode is increased relative to the surroundings, there is a still greater need to screen the corona electrode in the manner aforementioned. An increase in voltage, however, is also encumbered with an increase in the costs entailed, inter alia, by the high-voltage insulation in both the actual voltage source itself and in the ion-wind arrangement as such, and because of this there is naturally an upper limit to which the voltage can be increased in practice. One advantageous method of reducing these difficulties is to connect the corona and target electrodes to potentials of opposite polarities in relation to earth.

According to a further development of the invention it has proven possible, however, to increase the distance between the corona electrode K and the target electrode M substantially, and therewith the migration distance of the ion current, without any decisive reduction in the strength of the ion current between these two electrodes and without needing to increase the voltage level, by arranging a so-called excitation electrode E in the proximity of the corona electrode K, as illustrated by way of example in FIG. 7. In the exemplary embodiment of FIG. 7, this excitation electrode E has the form of a rotational symmetrical ring E comprising an electrically conductive material, or at least presenting a partially electrically conducting inner surface, which is arranged coaxially around the corona electrode K, which in this embodiment has the form of a needle electrode. In view of the particular configuration of the corona electrode K of the illustrated embodiment, the target electrode M has the form of a cylinder arranged coaxially in the duct, whereas the screen electrode S has the form of a ring arranged coaxially in relation to the corona electrode K and upstream thereof. Thus, the excitation electrode E is located at a shorter axial distance from the corona electrode K than the target electrode M and, in the illustrated embodiment, is connected to the same terminal of the d.c. voltage source 3 as the target electrode M, through a high ohmic resistance 6. The excitation electrode E thus adopts a potential having the same polarity as the potential of the target electrode M in relation to the corona electrode K. The potential difference between the excitation electrode E and the corona electrode K, however, becomes smaller than the potential difference between the target electrode M and the corona electrode K. The excitation electrode E contributes towards generating a corona discharge and maintaining the same at the corona electrode K, even when the distance between the corona electrode K and the target electrode M is increased without increasing the voltage of the voltage source 3 at the same time. Only a minor part of the corona ion-flow eminating from the corona electrode K will pass to the excitation electrode E, while the major part of this corona flow or current will still pass to the target electrode M and contribute in transporting air through the arrangement.

The effect produced by the excitation electrode E can be illustrated by the diagram shown in FIG. 8, in which the curve A illustrates the corona current I as a function of the voltage U between the corona electrode and the target electrode in the absence of an excitation electrode. As will be seen, no corona discharge, and therewith corona ion-current, will take place at all until a given threshold voltage $U_T$ is exceeded. On the other hand, when an excitation electrode is arranged adjacent the corona electrode, the circumstances illustrated by the curve B prevail, namely that a corona ion-current is initiated at a much lower voltage with the axial distance between corona electrode and target electrode unchanged. Only a part of this corona ion-current will flow to the excitation electrode, whereas the remainder passes to the target electrode.

The excitation electrode together with the target electrode can also be considered as a two-part target electrode, whose one part is located close to the corona electrode, when seen in the axial direction, and serves as an excitation electrode, while the other part is located at a substantial axial distance from said corona electrode and serves as a target electrode for that part of the corona ion-current providing the motive force for the air flow.

Figure 9:
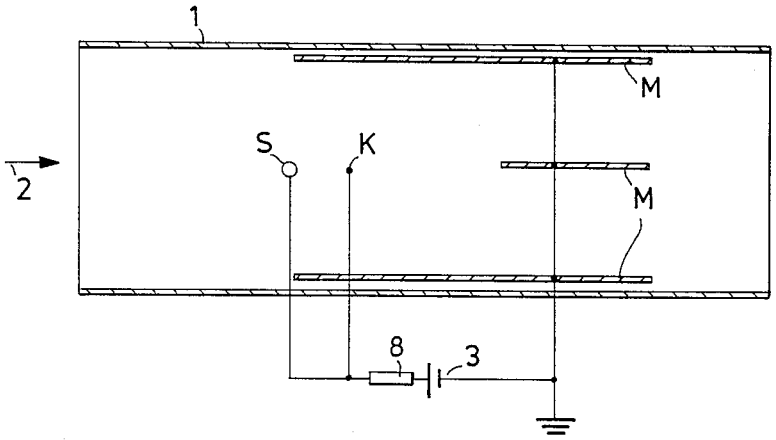

Consequently, an "excitation electrode" can be obtained, for example, in the manner illustrated in FIG. 9, by extending a part of the target electrode M axially towards the corona electrode K, up to the proximity of said electrode or even beyond the same; the target electrode M in this embodiment comprising a number of mutually parallel plates extending axially in the duct 1. In this case those parts of the target electrode M located axially nearest the corona electrode K function as an excitation electrode, although the major part of the corona ion-current will flow to that part of the target electrode located further away from the corona electrode in the axial direction, to generate the desired ion-wind. When the excitation electrode E is combined with the target electrode M in this manner, by extending the target electrode M axially to a location in the vicinity of the corona electrode, the target electrode may advantageously comprise a highly resistive material or a highly resistive surface coating applied to the inner surface of a tube of insulating material, the distal end of the target electrode M in relation to the corona electrode K being connected to one terminal of the d.c. voltage source 3. That part of the target electrode located nearest the corona electrode K in the axial direction will therewith serve as an excitation electrode E, which receives only a minor part of the corona ion-flow. Alternatively, a combined target and excitation electrode can be obtained by providing the target electrode M with parts which extend axially towards the corona electrode K and up to the vicinity thereof, and which exhibit a much smaller electrically conductive area than the major part of the target electrode M located further away from the corona electrode K and connected to one terminal of the d.c. source. Those parts of the target electrode of small conducting area located axially in the proximity of the corona electrode K will thus serve as an excitation electrode, to which only a minor part of the total corona ion-flow deriving from the corona electrode K will pass.

The excitation electrode can be formed and arranged in many different ways. Any form of electrode which is located in the axial proximity of the corona electrode K and which does not in itself produce a corona discharge and which is connected to one terminal of a direct-current voltage source, the other terminal of which is connected to the corona electrode, is able to serve as an excitation electrode, if only a minor part of the total corona ion-current flows to this excitation electrode while the larger part of the corona ion-current flows to the target electrode. Thus, a screen electrode located upstream of the corona electrode and arranged to receive a given, small ion-current, for example in accordance with the embodiment of FIG. 5, is able to function as an excitation electrode.

The geometric form of the excitation electrode E may also vary in dependence on the configuration of the corona electrode K. For example, when the corona electrode comprises a plurality of geometrically separated but electrically connected electrode elements, for example straight thin wires arranged side-by-side, the excitation electrode may advantageously also comprise a plurality of geometrically separated but electrically connected electrode elements, which are then arranged between the electrode elements of the corona electrode so as to be screened from each other, which in respect of such a corona electrode is advantageous to the creation of the corona ion-current.

FIG. 9 illustrates schematically and by way of example an arrangement according to the invention which incorporates a corona electrode K, a target electrode M, a screen electrode S and an excitation electrode E. In this embodiment each electrode comprises a plurality of geometrically separated but electrically connected electrode elements, which in the case of the corona electrode K comprise straight, thin wires made of tungsten for example, whereas the other electrodes comprise helically formed wires of, for example, stainless steel.

Since, as evident from the aforegoing, an arrangement according to the invention can be readily constructed so that all electrodes are safe to touch, it will be understood that the embodiments illustrated, for example, in FIGS. 4, 5, 7, 9 and 10, in which the target electrode M is earthed and the corona electrode K and the screen electrode and also optionally the excitation electrode E are connected to a higher potential, can also be constructed to exclude an airflow duct which surrounds the electrodes, provided that the screen electrode is constructed in a manner which ensures that it will effectively prevent the ion current eminating from the corona electrode from flowing in any other direction than towards the target electrode.

Although an arrangement according to the invention is able to function quite satisfactorily in the absence of any form of airflow duct around the electrodes of the arrangements, the provision of such a duct may be desirable in some instances, however, for example for psychological reasons or because such a duct will conduct the air through the arrangement in a more orderly fashion. The provision of such a duct may also be unavoidable in some instances, for example when the arrangement is to be placed within a ventilation duct in a ventilation system, or in other instances where the airstream generated by the arrangement is to be conducted from and/to specific locations. The presence of such an airflow duct which encloses the electrodes of the arrangement and the walls of which, quite naturally, consist of an electrically insulating material, gives rise to troublesome problems however. As discussed above with reference to FIG. 6, there appears on the inner surfaces of the wall of such a duct an excess of electrical surface charges. A similar excess of surface charges will naturally also appear on that part of the duct wall located between the corona electrode and the target electrode, and will influence the desired ion-current flowing from the corona electrode downstream towards the target electrode, in a manner such as to tend to restrict the ion-current to the central region of the cross-sectional area of the air-flow duct, which results in an uneven distribution of the airflow across the width of the duct, therewith impairing transportation of air therethrough. This problem is greatly exacerbated by variations in the voltage applied to the corona electrode and the target electrode through the aforesaid voltage source. A tempory increase in the voltage will namely result in an increase in the aforesaid surface charges, these charges persisting even when the voltage is subsequently lowered, and therewith cause a strong reduction in the corona current and therewith in the transporation of air through the arrangement. The drawbacks created by this phenomenon can be overcome, or at least greatly alleviated, by stabilizing the voltage delivered by the voltage source, this expedient being of no particular interest from other aspects in an arrangement of the kind in question, or by briefly cutting-off the voltage to the electrodes at uniformly spaced time intervals. The excess surface charges present on the inner surfaces of the duct wall namely disappear relatively quickly when the voltage supply is interrupted and the electric field thereby removed. The presence of excess electrical charges on the inner surfaces of the electrically insulating duct wall give rise, however, to an additional, highly surprising and serious problem. It has namely been found that when the inner surface of the insulating duct-wall is touched, even briefly, the flow of corona current will cease totally, and is not automatically stored, not even after the lapse of a very long period of time from when the surface was touched. Obviously, a solution to this problem must be found.

One possible solution to this problem is to apply an electrically conductive layer to the outer surface of the insulating wall of the duct and to earth said layer. However, this would give a high capacitance to a target electrode located in the close proximity of the duct wall, or located directly on the inner surface of said wall, which as mentioned in the aforegoing is undesirable with respect to the safe-to-touch aspect of the target electrode. It has been found possible to avoid this, however, by increasing the cross-sectional dimensions of the airflow duct to a size substantially greater than the corresponding dimensions of the area enclosed by the target electrode, so that the target electrode is located at a substantial distance from the inner surface of the airflow duct. One such embodiment is illustrated schematically in FIG. 11. In this embodiment, the outer surface of the insulating wall of the duct 1 is provided with an electrically conductive layer 10, which is earthed. The duct 1 of this embodiment is also significantly wider than the target electrode M, so that the duct walls are further away from the target electrode, which thereby obtains a much lower capacitance. The duct walls have, in this way, also been placed further away from the corona electrode K, and hence the excess charges occurring on the inner surface of the insulating duct-wall have a much less disturbing effect on the corona current flowing from the corona electrode K to the target electrode M. This increase in the cross-sectional dimensions of the airflow duct 1 in relation to the cross-sectional dimensions of the target electrode M has not been found to have any deleterious effect on the transporation of air through the arrangement, but that in fact such transportation is increased at an unchanged corona current. In the embodiment illustrated in FIG. 11, the centre point of the d.c. voltage source 3 is earthed, so that the target electrode M and the corona electrode K have opposite polarities in relation to earth, which restricts the total high-voltage level required and therewith the necessity to insulate the arrangement against high voltages, and also reduces the demands on the screening of the corona electrode K, as mentioned in the aforegoing. Since, in this case, a high voltage is applied to the screen electrode, the corona electrode and the target electrode, all of the said electrodes are connected to the d.c. voltage source through a large resistance 8 effective to limit the short circuiting current in the event of contact with the electrodes. Moreover, both the target electrode M and the screen electrode 7 are suitably manufactured from a material of high resistivity, in order to limit the capacitive discharge current in the event of contact.

In an embodiment of this kind, an advantage is gained when the cross-sectional dimensions of the airflow duct 1 are adapted so that the distance between the duct wall and corona electrode K is equal to approximately half the distance between the corona electrode and target electrode, and so that the distance between duct wall and the surface of the target electrode is approximately 50% of the cross-sectional dimension of the target-electrode aperture.

Figure 11:
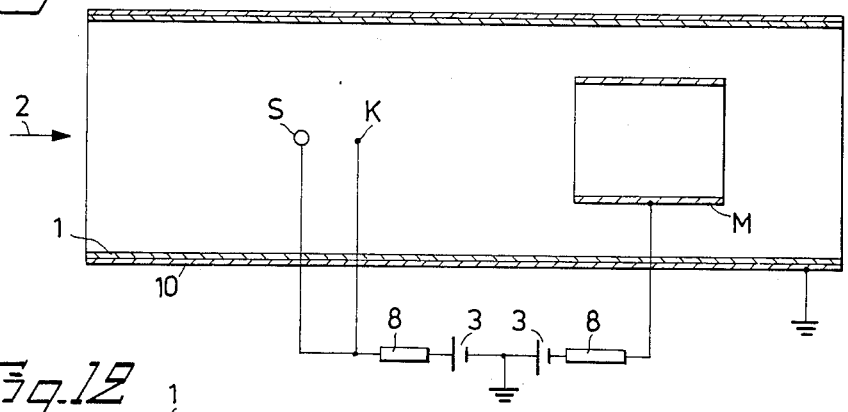

The aforedescribed unfavourable effects caused by the presence of excess charges on the inner surface of the duct wall can also be reduced with the aid of an excitation electrode having the function described in the aforegoing, this excitation electrode comprising an electrically conductive layer applied to the inner surface of the duct wall. As will be understood, no excess charges are able to appear on the inner surface of the duct wall in the presence of such an excitation electrode. If, in this respect, the cross-sectional dimensions of the airflow duct are increased to an extent such that the target electrode is located at a significant distance from the wall of the duct, as illustrated in FIG. 11 and described above, the excitation electrode mounted on the inner surface of the duct wall can be very surprisingly extended in the downstream direction, to a location beyond the target electrode. In actual fact, in this particular case an electrically conductive layer can be provided on the inner surface of the duct wall throughout the whole length of the duct, i.e. even in the upstream direction to a location beyond the corona electrode. One such embodiment is illustrated schematically in FIG. 12.

Figure 12:
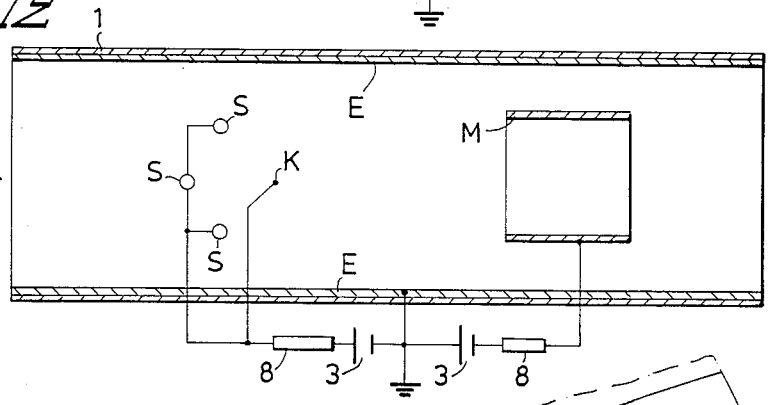
Figure 13:
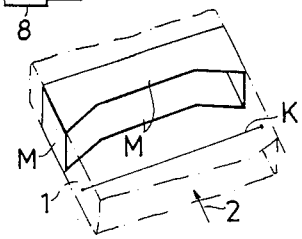

Thus, the embodiment illustrated in FIG. 12 includes an airflow duct 1, the wall of which is assumed to consist of an electrically insulating material and the inner surface of which is provided with an electrically conductive coating E, which is earthed and which functions as an excitation electrode in the vicinity of the corona electrode K. The cross-sectional dimensions of the duct 1 are such that a target electrode M, of frame-like configuration and extending parallel with the walls of the duct 1, is located at a significant distance from the inner surface of the duct wall, and is thus well insulated from the electrically conductive coating E on the inner surface of the duct wall. Located upstream of the corona electrode K is a number of screen electrodes S, for example in the form of coarse rods. The d.c. voltage source is earthed at its central point, so that the corona electrode K and the target electrode M have opposite polarities in relation to earth, which affords the aforedescribed advantages. The electrodes are also connected to the d.c. voltage source through large resistances 8, to limit the short circuiting current. It will be seen that no excess surface charges whatsoever can appear on the inner surface of the duct wall in an embodiment of the arrangement such as this, and hence the arrangement is not encumbered with those problems arising from the presence of such excess surface charges. This embodiment of an arrangement according to the invention has also been found to transport air in an exceedingly satisfactory manner. The conditions mentioned above with reference to FIG. 11 also apply with regard to the dimensioning of the airflow duct 1 of the FIG. 12 embodiment.

It will be understood that since it is possible with an arrangement such as that illustrated in FIG. 12 to provide the inner surface of the duct wall with an electrically conductive, earthed coating along the whole length of the duct, there is nothing to prevent the duct wall from consisting entirely of an electrically conductive material, which would naturally facilitate manufacture considerably, and also afford other valuable advantages. Thus, it is possible that the inner surface of the duct be lined, at least along a given part of its length, with a chemically adsorbing or absorbing material, for example a carbon filter, effective to remove gaseous contaminents from the air, such as odours and the oxides of nitrogen generated by the corona discharge, by absorption or adsorption. It is also possible, for the same purpose, to pass a thin liquid film, for example water or a chemically active liquid, along the inner surface of the airflow duct. The wall of the air-flow duct can also be cooled or heated, with the aid of suitable means, for example circulating water, in order to cool or heat the transported air. All this is made possible by the fact that the wall of the airflow duct is electrically conductive and earthed.

In those embodiments of the arrangement according to the invention in which the electrodes are enclosed in an airflow duct it has been found to be advantageous to use one single corona electrode K arranged centrally therein, since the greatest possible distance between the duct wall and the corona electrode is obtained in this way, and therewith the least possible disturbance in the function of the corona electrode as a result of the duct wall. Alternatively, there can be used, however, two corona electrodes placed symmetrically on a respective side of the symmetry plane of the duct. In this arrangement each electrode will be affected solely by one wall or side of the duct and both electrodes will operate under mutually similar conditions. This does not apply, however, when more than two electrodes are installed in the duct. In those embodiments where two corona electrodes are placed symmetrically in the airflow duct, it can be to advantage to also install two target electrodes side-by-side in a similar symmetrical relationship, the target electrodes in this respect suitably having a common electrically conducting wall.

In the case of an embodiment such as that illustrated in FIG. 12, it will be understood that the electrically conductive and earthed coating or lining E on the inside of the insulating airflow duct 1 need not be extended upstream of the corona electrode K, in which case the excess charges consequently appearing on the inner surface of the electrically conductive duct wall upstream of the corona electrode K will co-operate in establishing the necessary screening of the corona electrode K.

A further problem, affecting the total transportation of air through an arrangement of this kind, occurs when the corona electrode has the form of a wire extending across the path of the airflow and attached at both ends to electrically insulated attachment means. The same problem can also occur with other types of electrode which extend across the path of the airflow. In this respect it has been found that the corona electrode gives much more corona current per unit of length within the central region of the airflow path than at the end parts of the electrode. This would appear to be due to a screening effect created through the electrode attachment means and through the wall of the duct at both ends of the electrode, when an airflow duct is included in the arrangement. In the case of a low corona current, a considerable part of both ends of the corona electrode can even be "extinguished" or cut-out. This results in uneven distribution of the ion current and therewith uneven distribution of the airflow across the cross-sectional area of the path taken by the airflow. When the arrangement incorporates an airflow duct which surrounds the electrodes, it has been found that when seen in cross-section, those parts of the airflow duct located opposite respective ends of the corona electrode exhibit an airflow which moves in a direction opposite to that intended. This phenomenon can greatly impair, and even totally eliminate effective transportation of air through the arrangement. This problem can be overcome, however, in accordance with a further development of the invention, by giving the target electrode and/or the excitation electrode a particular form. An embodiment of a target electrode suitably formed in this latter respect is illustrated schematically and by way of example in FIG. 3, which shows an arrangement according to the invention, incorporating an airflow duct 1, shown in broken lines, of narrow, elongated rectangular cross-section. Extending across the duct 1, between the two short walls thereof, is a wire-like corona electrode K. The target electrode M has the form of a conductive layer or coating on the inner surfaces of the duct wall and, in this embodiment, is so formed that when seen in the axial direction of the duct it lies closer to the end portions of the corona electrode K than to the central region of said corona electrode in the transverse direction of the duct. For example, the axial distance between the target electrode M and the corona electrode K at the centre region thereof may be 60 mm, while the corresponding axial distance from the target electrode to the opposite located end portions of the corona electrode is only 40 mm. A target electrode M of this configuration will eliminate the problem discussed above, so as to obtain substantially uniform distribution of the corona current along the whole length of the corona electrode.

The same result can be achieved when an excitation electrode arranged between the corona electrode K and the target electrode M is formed in the manner described above with reference to FIG. 13 in respect of the target electrode. In this case the target electrode can either be formed in the manner illustrated in FIG. 13 or in a normal manner, i.e. so that its axial distance from the corona electrode is the same at all points thereon. A corresponding result can also be obtained with the aid of excitation electrodes which are located solely in the vicinity of both end portions of the corona electrode. A most essential feature, however, is that the target electrode and/or the excitation electrodes is, or are, so formed that the corona electrode K extending across the airflow path provides substantially the same amount of corona current per unit length over the whole of its length, i.e. even at the end portions of the corona electrode.

A target electrode and excitation electrode having the form described with reference to FIG. 12 may also be used to advantage in an arrangement in which the electrodes are not enclosed in an airflow duct, since a target electrode and excitation electrode thus formed will enable the corona current to be distributed more uniformly over the whole length of the electrode.

Figure 10:
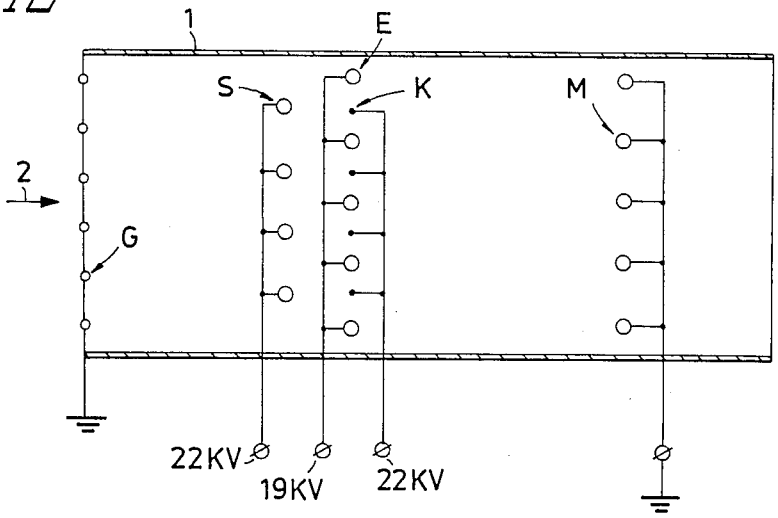

An arrangement according to the invention and constructed in accordance with the embodiment illustrated in FIG. 10 was used in practice for experimental purposes. In this experimental arrangement, the distance between the plane of the screen electrode S and the plane of the corona electrode K was 12 mm, whereas the distance between the plane of the corona electrode K and the target electrode M was 85 mm. The mutual distance between the wire-like electrode elements in the corona electrode K was 50 mm, and the electrode element of the excitation electrode E was arranged in the same plane as the electrode elements of the corona electrode K centrally therebetween. The various electrodes were connected to the voltages given in the drawings. The airflow duct 1 measured 35×22 cm in cross-section, and an earthed protective grid G was arranged at the inlet to the duct. When this apparatus was placed freely on a table, an airflow velocity in excess of 0.5 m/s was obtained. The total corona current from the corona electrode K was about 50 μA, of which about 40 μA passed to the target electrode M. An airflow velocity of about 0.5 m/s was obtained at a power consumption of 5–6 $W/m^2$ of the area of the flow duct. The power required to obtain a corresponding airflow velocity in a similar apparatus lacking the screen electrode S and the excitation electrode E but with the same voltage on the corona electrode was about 100 $W/m^2$. In this case, the distance between the corona electrode K and the target electrode M was about 50 mm, and the distance between the corona electrode K and the protective grid G at the duct inlet was 100 mm. In this embodiment of the apparatus according to the invention, the distance of the protective grid G from the corona electrode K had no noticable influence on the efficiency of the apparatus.

The transportation of air through an arrangement, or apparatus, constructed in accordance with the invention can be further increased by arranging a plurality of electrode arrays, each array comprising a corona electrode, target electrode, screen electrode and optionally an excitation electrode, sequentially in one and the same airflow duct. The arrangement of a screen electrode upstream of each corona electrode, in the aforedescribed manner, will effectively prevent the undesirable and harmful flow of ions in the upstream direction, such flow being unavoidable in such a cascade arrangement in the absence of a screen electrode.

The arrangement provides an extremely effective air transporting arrangement of relatively simple construction. In addition, an arrangement constructed in accordance with the invention is relatively inexpensive, and has small dimensions and a low weight. Such an arrangement also has a low energy consumption and is absolutely silent in operation.

When an air transporting arrangement according to the invention is used in conjunction with an electrostatic filter device, the target electrode M in the air transporting arrangement can be arranged to form simultaneously parts of the precipitation surfaces incorporated in the electrostatic filter arrangement for receiving the impurities charged upon collision with the air ions, for example in a capacitor separator of a kind known per se. When the target electrode M functions as a precipitation surface for impurities carried by the air transported through the arrangement, the target electrode is suitably constructed in a manner which enables it to be readily dismantled for replacement or cleaning purposes when the electrode becomes excessively coated with precipitated contaminents. It will be seen that this can be readily achieved when the arrangement does not incorporate an airflow duct surrounding the electrodes. In contexts such as these the target electrode can conceivably have the form of strip material fed from a storage reel or fed through a cleansing device when the part of the strip material used as a target electrode has been dirtied by precipitated contaminents.

We claim:

1. An apparatus for transporting air with the aid of an electric ion-wind, comprising at least one corona electrode and at least one target electrode which is permeable to an airflow through the apparatus and which is located at a distance from and downstream of the corona electrode, as seen in the direction of said airflow; a d.c. voltage source having one terminal thereof connected to the corona electrode and the other terminal thereof connected to the target electrode, the construction of the corona electrode and the voltage between the terminals of the voltage source being such that a corona discharge generating air ions occurs at the corona electrode; and screening means for screening the corona electrode in a direction upstream of said corona electrode, such that the product of the value of any ion current in said upstream direction and the distance migrated by said any ion current from the corona electrode is practically zero, or in all events much smaller than the product of the value and the migration distance of the ion current in a direction downstream from the corona electrode to the target electrode; and the distance between the corona electrode and the part of the target electrode receiving the predominant part of said downstream ion current being at least 50 mm.

2. An apparatus as claimed in claim 1, wherein the distance between the corona electrode and the part of the target electrode receiving the predominant part of the downstream ion current is at least 80 mm.

3. An apparatus as claimed in claim 1, wherein said screening means include any electric connection between the corona electrode and ground potential.

4. An apparatus as claimed in claim 1, wherein said screening means include an electrically conductive screen electrode located upstream of the corona electrode and having a potential of the same polarity in relation to the target electrode as the potential of the corona electrode.

5. An apparatus as claimed in claim 4, wherein the screen electrode is electrically connected to the corona electrode.

6. An apparatus as claimed in claim 1, wherein said screening means include an airflow duct enclosing at least the corona electrode and having walls consisting of a dielectric material, which walls are extended upstream of the corona electrode through a distance which is at least equal to the distance between the corona electrode and the target electrode.

7. An apparatus as claimed in claim 6, wherein the walls of said airflow duct are extended upstream of the corona electrode through a distance which is at least 1.5 times the distance between the corona electrode and the target electrode.

8. An apparatus as claimed in claim 6, wherein said airflow duct upstream of the corona electrode is provided with partition walls made of a dielectric material and extending substantially parallel to the longitudinal extension of the duct.

9. An apparatus as claimed in claim 1, comprising an excitation electrode located in the vicinity of the corona electrode at a shorter axial distance therefrom than the target electrode; said excitation electrode being connected to a potential of the same polarity relative to the corona electrode as the potential of the target electrode to co-operate in the generation of the corona discharge at the corona electrode without giving rise to a corona discharge at itself, the part of the total ion current passing from the corona electrode to the excitation electrode being substantially smaller than that part of said total ion current passing to the target electrode.

10. An apparatus as claimed in claim 9, wherein the potential difference between the excitation electrode and the corona electrode is smaller than the potential difference between the target electrode and the corona electrode.

11. An apparatus as claimed in claim 10, wherein the excitation electrode is connected to the same terminal of the d.c. voltage source as the target electrode through a large resistance.

12. An apparatus as claimed in claim 1, wherein the target electrode is extended towards the corona electrode up to the axial proximity at the corona electrode, the electrically conductive material of the target electrode has a high resistivity and said other terminal of the d.c. voltage source is connected to the part of the target electrode located furthest away from the corona electrode, whereby said part of the downstream ion current from the corona electrode and the part of the target electrode located in the axial proximity of the corona electrode is functioning as an excitation electrode assisting the generation of the corona discharge at the corona electrode.

13. An apparatus as claimed in claim 1, wherein the target electrode is provided with electrically conductive parts extending axially towards the corona electrode up to the axial proximity of the corona electrode and having a substantially smaller electrically conductive area than the major part of the target electrode located at a substantial axial distance from the corona electrode, said major part being connected to said other terminal of the d.c. voltage source to receive the predominant part of the downstream ion current from the corona electrode, and said parts located in the axial proximity of the corona electrode functioning as an excitation electrode assisting the generation of the corona discharge at the corona electrode.

14. An apparatus as claimed in claim 1, wherein the target electrode comprises electrically conductive surfaces which extend parallel with the direction of airflow and enclose the airflow path.

15. An apparatus as claimed in claim 1, wherein the electrodes are arranged within an airflow duct and the target electrode comprises electrically conductive surfaces on the wall of the airflow duct.

16. An apparatus as claimed in claim 1, wherein the electrodes are arranged within an airflow duct, the target electrode comprises electrically conductive surfaces which extend parallel with the wall of the airflow duct and are located at a distance inwardly thereof; and the wall of said airflow duct comprises electrically insulating material and has located externally thereof an earthed electrically conductive surface.

17. An apparatus as claimed in claim 1, wherein the electrodes are arranged within an airflow duct having a wall having at least one electrically conductive inner surface which is earthed; the target electrode comprises electrically conductive surfaces which are parallel with the wall of the airflow duct and located at a substantial distance inwardly thereof; and the target electrode and the corona electrode are connected to potentials of opposite polarities in relation to earth.

18. An apparatus as claimed in claim 17, wherein the wall of the airflow duct is electrically conductive in its entirety.

19. An apparatus as claimed in claim 17, wherein the airflow duct has a wall which consists of an electrically insulating material and which is provided on the inner surface thereof with an electrically conducting layer which extends axially approximately from the corona electrode to a location downstream of the target electrode.

20. An apparatus as claimed in claim 16, wherein the distance between the wall of the airflow duct and the nearest lying surface of the target electrode corresponds approximately to 50% of the cross-section dimension of the area surrounded by the target electrode.

21. An apparatus as claimed in claim 17, wherein at least a part of the inner surface of the airflow duct is provided with a layer of chemically absorbing material.

22. An apparatus as claimed in claim 17, wherein at least part of the inner surface of the airflow duct is flushed with water or a chemically active liquid.

23. An apparatus as claimed in claim 17, comprising means for controlling the temperature of the duct wall.

24. An apparatus as claimed in claim 1, wherein electrodes having a high potential in relation to earth are connected to the d.c. voltage source through resistances of such high resistance value, that in the event of any of said electrodes being earthed the resultant short circuiting current will reach at most approximately 300 $\mu$A.

25. An apparatus as claimed in claim 1, wherein electrodes having a potential which differs from each potential and a substantial capacitance comprise a material of high resistivity, so that in the event of contact with any of said electrodes the capacitive discharge current will be limited to an acceptable value.

26. An apparatus as claimed in claim 1, wherein the corona electrode and the target electrode are connected to potentials of opposite polarities in relation to earth.

27. An apparatus as claimed in claim 1, wherein the corona electrode extends transversely across the airflow path; the target electrode comprises an electrically conductive surface which embraces said path and extends parallel thereto; and the axial distance between the corona electrode and the nearest edge of the conductive surface of said target electrode is shorter at locations opposite the end portions of the corona electrode than at locations opposite the center region of said corona electrode.

28. An apparatus as claimed in claim 9, wherein the corona electrode extends transversely across the airflow path; the excitation electrode comprises an electrically conductive surface embracing said airflow path and extending parallel therewith; and the axial distance between the corona electrode and the nearest edge of the conductive surface of the excitation electrode is shorter at locations opposite the end portions of the corona electrode than at locations opposite the central region of said corona electrode.

29. An apparatus as claimed in claim 9, wherein the corona electrode extends transversely across the airflow path; the excitation electrode comprises electrically conductive surfaces extending parallel with the airflow path; and the electrically conductive surfaces forming said excitation electrode are located substantially axially opposite the end parts of the corona electrode.

* * * * *